US011359630B2

(12) United States Patent
Hebrard et al.

(10) Patent No.: US 11,359,630 B2
(45) Date of Patent: Jun. 14, 2022

(54) SCREW COMPRESSOR FOR A UTILITY VEHICLE

(71) Applicants: Gilles Hebrard, Munich (DE); Jean-Baptiste Marescot, Munich (DE); Joerg Mellar, Munich (DE); Thomas Weinhold, Munich (DE)

(72) Inventors: Gilles Hebrard, Munich (DE); Jean-Baptiste Marescot, Munich (DE); Joerg Mellar, Munich (DE); Thomas Weinhold, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 379 days.

(21) Appl. No.: 16/333,395

(22) PCT Filed: Sep. 19, 2017

(86) PCT No.: PCT/EP2017/073546
§ 371 (c)(1),
(2) Date: Apr. 18, 2019

(87) PCT Pub. No.: WO2018/054862
PCT Pub. Date: Mar. 29, 2018

(65) Prior Publication Data

US 2019/0390673 A1 Dec. 26, 2019

(30) Foreign Application Priority Data

Sep. 21, 2016 (DE) ..... 10 2016 011 394.4

(51) Int. Cl.
*F04C 23/00* (2006.01)
*F04C 18/16* (2006.01)
(Continued)

(52) U.S. Cl.
CPC ..... *F04C 23/008* (2013.01); *F04C 18/16* (2013.01); *F04C 27/008* (2013.01);
(Continued)

(58) Field of Classification Search
CPC ..... F04C 18/16; F04C 23/008; F04C 27/008; F04C 29/005; F04C 29/026; F04C 29/028;
(Continued)

(56) References Cited

U.S. PATENT DOCUMENTS 3,776,668 A 12/1973 Abendschein
4,478,054 A 10/1984 Shaw et al.
(Continued)

FOREIGN PATENT DOCUMENTS

CN 1067485 A 12/1992
CN 1301944 A 7/2001
(Continued)

OTHER PUBLICATIONS

Chinese-language Office Action issued in counterpart Chinese Application No. 201780068585.2 dated Nov. 28, 2019 with English translation (nine (9) pages).
(Continued)

*Primary Examiner* — Audrey B. Walter
*Assistant Examiner* — Dapinder Singh
(74) *Attorney, Agent, or Firm* — Crowell & Moring LLP

(57) ABSTRACT

A screw compressor for a utility vehicle includes at least one housing, at least one housing cover and at least one rotor housing. At least one seal is provided, wherein, when assembled, there is an oil sump in the housing, and the seal is arranged between the housing cover and the rotor housing and projects out of the oil sump with respect to the assembled state. The seal is formed as a sealing plate and has multiple passage openings.

10 Claims, 2 Drawing Sheets

(51) Int. Cl.

| | |
|---|---|
| ***F04C 27/00*** | (2006.01) |
| ***F04C 29/00*** | (2006.01) |
| ***F04C 29/02*** | (2006.01) |
| ***F04C 29/04*** | (2006.01) |

(52) U.S. Cl.
CPC ..... *F04C 29/005* (2013.01); *F04C 29/026* (2013.01); *F04C 29/028* (2013.01); *F04C 29/04* (2013.01); *F04C 2220/40* (2013.01); *F04C 2240/30* (2013.01); *F04C 2240/809* (2013.01)

(58) Field of Classification Search
CPC .. F04C 29/04; F04C 2240/30; F04C 2240/40; F04C 2240/809; F01C 21/007
USPC ..... 418/201.1, 270, 99–100
See application file for complete search history.

(56) References Cited

U.S. PATENT DOCUMENTS

| | | | | |
|---|---|---|---|---|
| 4,780,061 | A | 10/1988 | Butterworth | |
| 5,240,392 | A | 8/1993 | Fukanuma et al. | |
| 5,246,357 | A | 9/1993 | Sjoholm et al. | |
| 6,237,362 | B1 * | 5/2001 | Jang | F04B 39/16 62/469 |
| 6,769,890 | B2 * | 8/2004 | Vigano' | F04C 18/086 418/178 |
| 7,234,926 | B2 * | 6/2007 | Sowards | F04C 18/023 417/295 |
| 7,891,955 | B2 * | 2/2011 | Picouet | F04B 49/03 417/213 |
| 2003/0147764 | A1 | 8/2003 | Kreihn et al. | |
| 2003/0175140 | A1 | 9/2003 | Yamanaka et al. | |

FOREIGN PATENT DOCUMENTS

| | | | |
|---|---|---|---|
| CN | 1415055 | A | 4/2003 |
| CN | 103410729 | A | 11/2013 |
| CN | 105443742 | A | 3/2016 |
| DE | 2 307 240 | A | 8/1973 |
| EP | 2 538 118 | A1 | 12/2012 |
| KR | 10-0318418 | B1 | 12/2001 |
| WO | WO 01/48385 | A1 | 7/2001 |

OTHER PUBLICATIONS

International Search Report (PCT/ISA/210) issued in PCT Application No. PCT/EP2017/073546 dated Nov. 21, 2017 with English translation (six (6) pages).
German-language Written Opinion (PCT/ISA/237) issued in PCT Application No. PCT/EP2017/073546 dated Nov. 21, 2017 (six (6) pages).
German-language Office Action issued in counterpart Japanese Application No. 102016011394.4 dated Jul. 20, 2017 (five (5) pages).
Cover page of EP 1 242 743 A1 published Sep. 25, 2002 (one (1) page).
Korean-language Office Action issued in Korean Application No. 10-2019-7010286 dated Jun. 1, 2020 with English translation (10 pages).

* cited by examiner

SCREW COMPRESSOR FOR A UTILITY VEHICLE

BACKGROUND AND SUMMARY OF THE INVENTION

The present invention relates to a screw compressor for a utility vehicle, having at least one housing, having at least one housing cover and having at least one seal.

Screw compressors for utility vehicles are already known from the prior art. Such screw compressors are used to provide the compressed air required for the brake system of the utility vehicle, for example.

In this context, in particular oil-filled compressors, in particular also screw compressors, are known, in the case of which it is necessary to regulate the oil temperature. This is generally realized by virtue of an external oil cooler being provided which is connected to the oil-filled compressor and to the oil circuit via a thermostat valve. Here, the oil cooler is a heat exchanger which has two mutually separate circuits, wherein the first circuit is provided for the hot liquid, that is to say the compressor oil, and the second circuit is provided for the cooling liquid. As cooling liquid, use may for example be made of air, water mixtures with an antifreeze, or another oil.

This oil cooler must then be connected to the compressor oil circuit by means of pipes or hoses, and the oil circuit must be safeguarded against leakage.

This external volume must furthermore be filled with oil, such that the total quantity of oil is also increased. The system inertia is thus increased. Furthermore, the oil cooler must be mechanically accommodated and fastened, either by means of brackets situated in the surroundings or by means of a separate bracket, which necessitates additional fastening means and also structural space.

U.S. Pat. No. 4,780,061 has already disclosed a screw compressor with an integrated oil cooling arrangement.

It is the object of the present invention to advantageously further develop a screw compressor for utility vehicles of the type mentioned in the introduction, in particular such that the removal of oil from the compressed air can be improved and simplified.

This object is achieved according to the invention by a screw compressor for a utility vehicle to be equipped with at least one housing which has at least one housing cover and at least one rotor housing, and with at least one seal, wherein, in the assembled state, an oil sump is present in the housing. In relation to the assembled state, the seal is arranged between housing cover and rotor housing and projects out of the oil sump. The seal is formed as a sealing panel and has multiple passage openings.

The housing may be of two-part or multi-part form. The multi-part form is produced in particular by virtue of the housing being assembled from a housing cover and a rotor housing.

The invention is based on the underlying concept that, in the case of an oil-filled screw compressor with an oil sump, small oil droplets, oil aerosols or an oil vapor are/is present above the oil sump, and in this way parts of the oil can pass on to particular regions of the housing. In order to improve and simplify the removal of oil from the compressed air, it is achieved by means of the design of the sealing panel that projects out of the oil sump that, although oil can still pass into all regions of the housing in the interior of the screw compressor, this displacement of oil by way of small oil droplets, oil vapors or oil aerosols is limited by the seal and by the passage openings of the seal. In other words, by means of the seal, a type of oil catcher is provided which is situated in the interior of the housing, at which a passage of oil is permitted only through the passage openings, and at which, furthermore, the small oil droplets and oil aerosols accumulate and can be separated off on the sealing panel. From there, they can then flow back into the oil sump.

Provision may furthermore be made whereby the seal divides the housing interior asymmetrically into at least one first region and at least one second region, wherein the first region is smaller than the second region. In this way, it is for example possible to achieve that particular regions which are to be supplied to a greater extent with smaller oil droplets and with oil aerosols or oil vapors are reached more easily, and the first region, which is formed so as to be smaller than the second region, is supplied to a lesser extent with small oil droplets and with oil aerosols or oil vapors.

The screw compressor may have an air/oil separator and an air/oil separator inflow, wherein the air/oil separator inflow opens into the housing interior of the screw compressor, and wherein the passage openings of the seal are arranged in the vicinity of the air/oil separator inflow. In this way, it is made possible for the air/oil separator to be of relatively small form. In particular, it is made possible for the introduction of oil into the oil separator to be limited by means of the design and arrangement of the seal. By virtue of the fact that the passage openings of the seal are arranged in the vicinity of the air/oil separator inflow, the introduction of oil into the air/oil separator inflow and thus into the air/oil separator is thus already reduced.

Provision may furthermore be made for the air/oil separator inflow to be formed in the housing cover. It is thus made easier to manufacture the air/oil separator inflow. Also, in this way, the arrangement of air/oil separator inflow and seal, which in the in assembled state is situated between rotor housing and housing cover, can be adjusted relatively easily. In particular, provision may be made whereby the air/oil separator inflow opens into the first region of the housing interior. Consequently, the air/oil separator inflow opens out in that region of the housing interior which is formed so as to be smaller than the second region, wherein the first and the second region are separated from one another by the seal. Provision may furthermore be made whereby, in relation to the assembled state, in the case of a substantially horizontal orientation of the screw compressor and in the case of a substantially horizontal orientation of the oil sump, the seal is arranged substantially vertically. It is thus made possible to simplify the return of the oil, which collects at the seal, into the oil sump. Owing to gravitational force, said oil can easily flow back into the oil sump again.

The passage openings may be of substantially round, in particular circular form. This design of the passage openings permits simple manufacture and production of the seal. However, in this context, any other shape of the passage openings is also possible. This can yield further advantages, for example that the limitation of the displacement of oil owing to small oil droplets, oil vapors or oil aerosols is improved.

Provision may furthermore be made whereby the seal is formed at least in regions, with the region situated in the housing interior in the assembled state, as a perforated plate. This permits simple manufacture and production of the seal. The stability of the seal can also be influenced and positively configured in this way. By means of a uniform arrangement of the holes in the regions in which the seal is formed as a perforated plate, it is possible to provide a good area of passage openings without weakening the seal as a whole.

The seal may furthermore have a baffle plate passage opening. It is conceivable in particular for the baffle plate passage opening to be formed so as to be situated, in the assembled state, approximately at the height of the level of the surface of the oil sump. The baffle plate and the seal may be arranged substantially perpendicular to one another. Through the formation of the baffle plate passage opening, a simple design and assembly of seal and baffle plate is made possible overall.

The provision of a baffle plate makes it possible for major parts of the oil sump to be retained in the lower-lying regions of the screw compressor even during the operation of the screw compressor and in particular during driving operation of the utility vehicle, without the need for surging of the oil back and forth to be compensated.

The seal may have screw bolt passages which are provided for the passage of screw bolts by means of which the seal, housing cover and rotor housing are screwed together. Simple, secure and reliable installation of the seal between housing cover and rotor housing is made possible in this way.

Further details and advantages of the invention will now be described in more detail on the basis of an exemplary embodiment illustrated in the drawings.

DETAILED DESCRIPTION OF THE DRAWINGS

Figure 1:
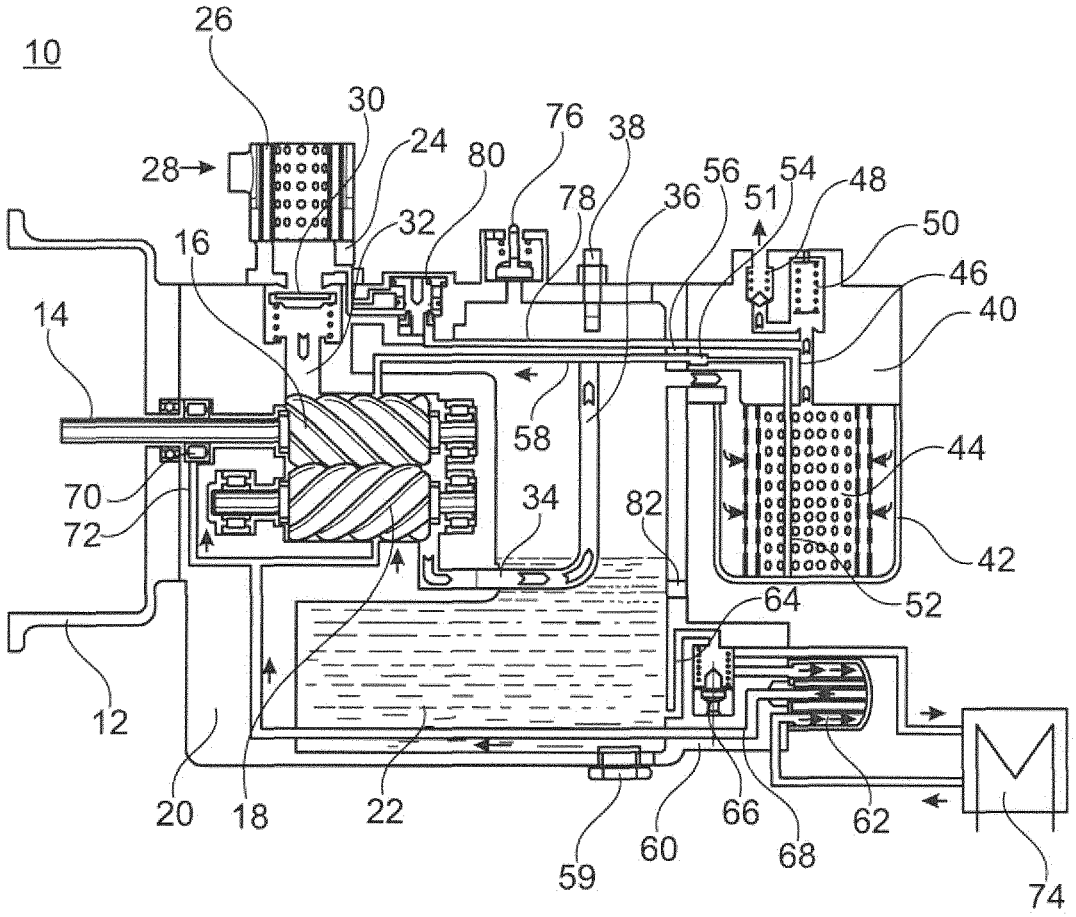
FIG. 1 shows a schematic sectional drawing through a screw compressor according to the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to an electric motor (not shown in any more detail here).

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

The valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by which the oil temperature can be monitored.

Also provided in the air outlet region is a holder 40 for an air/oil separator 42.

In the assembled state, the holder 40 for the air/oil separator 42 has the air/oil separator 42 in the region facing toward the base (as also shown in FIG. 1).

Also provided, in the interior of the air/oil separator 42, is a corresponding filter screen or known filter and oil separating devices 44, which will not be specified in any more detail.

In the central upper region in relation to the assembled and operationally ready state (that is to say as shown in FIG. 1), the holder 40 for the air/oil separator 42 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air/oil separator 42 to be returned into the housing 20, a riser line 52 is provided which has a filter and check valve 54 at the outlet of the holder 40 for the air/oil separator 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided in the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60.

In the upper region of the housing 20 (in relation to the assembled state), there is situated a safety valve 76, by which an excessively high pressure in the housing 20 can be dissipated.

Upstream of the minimum pressure valve 50, there is situated a bypass line 78, which leads to a relief valve 80. Via said relief valve 80, which is activated by a connection to the air feed 32, air can be returned into the region of the air inlet 28. In this region, there may be provided a ventilation valve (not shown in any more detail) and also a nozzle (diameter constriction of the feeding line).

Furthermore, approximately at the level of the line 34, an oil level sensor 82 may be provided in the outer wall of the housing 20. The oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows.

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air/oil separator 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by means of the thermostat valve 66. After purification in the oil filter 62, oil is fed via the line 68 to the screw 18 or to the screw 16, and also to the bearing 70. The screw 16 or the screw 18 is supplied with oil 22 via the return line 52, 58, and the purification of the oil 22 takes place here in the air/oil separator 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, and that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
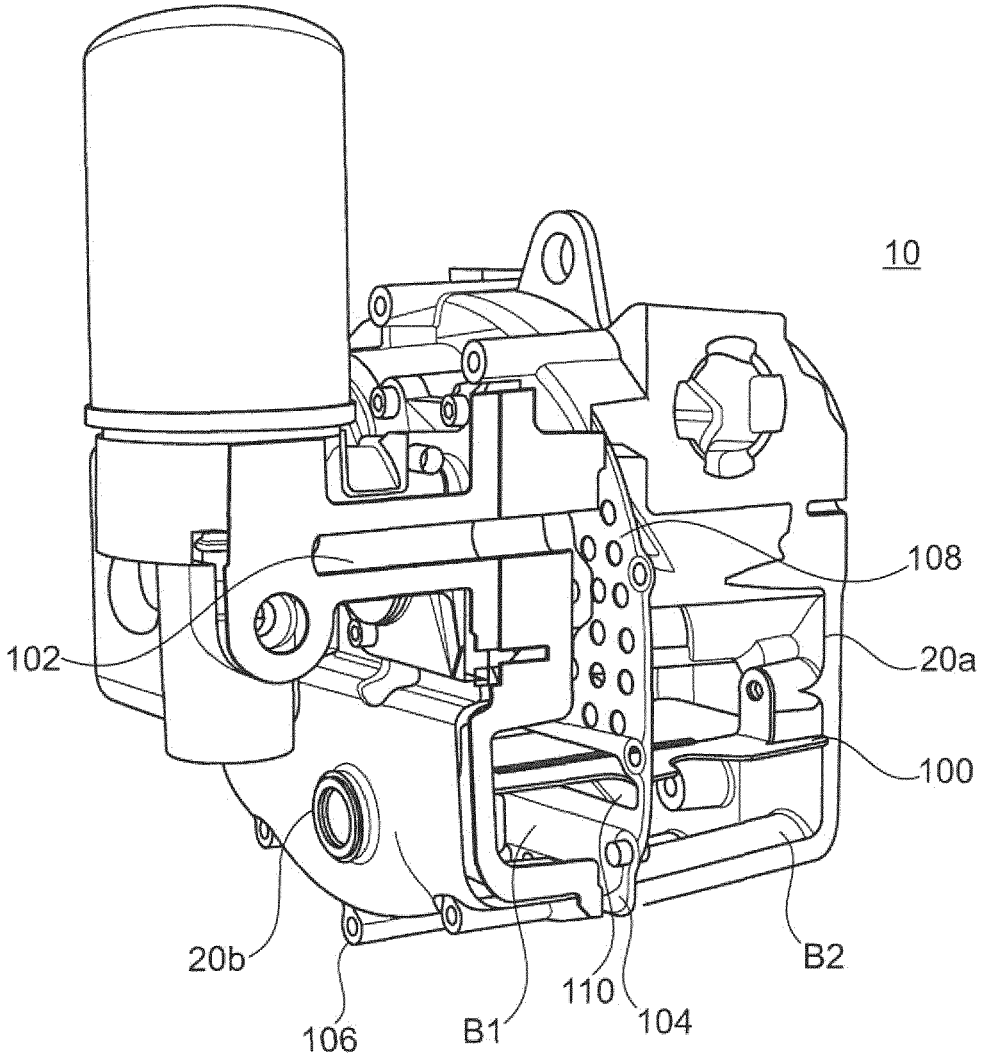
FIG. 2 shows a perspective sectional illustration through the screw compressor with a view of the housing interior of the screw compressor.

FIG. 2 shows, in a perspective schematic illustration, the screw compressor 10 as per FIG. 1 in a sectional illustration with a view of the interior of the housing 20 of the screw compressor 10.

Arranged in the interior of the housing 20 is a baffle plate 100 which is situated substantially at the height of the upper level of the oil sump of the oil 22. The assembled state and a horizontal arrangement of the upper level of the oil sump are assumed here.

The housing 20 has a housing cover 20*b* and a rotor housing 20*a*.

An air/oil separator inflow 102, which is connected to the air/oil separator 42, is situated in the housing cover 20*b*.

Between the housing cover 20*b* and the rotor housing 20*a*, there is provided a seal 104 which runs in encircling fashion between the edges of the housing cover 20*b* and rotor housing 20*a* in the assembled state and which is clamped and screwed with sealing action between these.

For this purpose, the seal 104 has screw bolt passage openings 106 through which corresponding screw connections by means of screw bolts can be led, such that seal 104, housing cover 20*b* and rotor housing 20*a* can be screwed together, and are screwed together in the assembled state.

In relation to the assembled state of the screw compressor 10, seal 104 is arranged between housing cover 20*b* and rotor housing 20*a* and projects out of the oil sump of the oil 22.

The seal 104 is formed as a sealing panel and has multiple passage openings 108.

The passage openings 108 are of circular form and are arranged so as to be offset relative to one another in a regular pattern in the manner of a perforated plate in that region of the seal 104 which is situated above the oil sump.

The seal 104 divides the housing interior asymmetrically into at least a first region B1, which relates substantially to the internal regions of the housing cover 20*b*, and a second region B2, which relates substantially to the interior of the rotor housing 20*a*. Here, the first region B1 is smaller than the second region B2.

The air/oil separator inflow 102 opens into the first region B1 and is situated in the vicinity of the passage openings 108 of the seal 104.

As can also be seen from FIG. 2, in relation to the assembled state, in the case of a substantially horizontal orientation of the screw compressor 10 and in the case of a substantially horizontal orientation of the oil sump of the oil 22, the seal 104 is arranged vertically.

Furthermore, at the height of the upper level of the oil sump of the oil 22, the seal 104 has a passage opening 110 for the baffle plate 100.

The function of the seal 104 and of its passage openings 108 can be described as follows.

During operation, the screws 16 and 18 are lubricated by pressurized oil of the oil 22 from the oil sump, such that oil vapors are present above the upper level of the oil sump. Further oil movements are forced by the driving movements of the utility vehicle, such that the movement of the oil 22 and the movement capabilities of the oil 22 are restricted by means of the baffle plate 100 and also the seal 104. At the same time, however, by means of the passage openings 108 both in the baffle plate 100 and in the seal 104, it is achieved that sufficient oil 22 in the form of oil vapors, oil aerosols or small oil droplets can pass into all regions of the screw compressor 10.

To reduce the introduction of oil into the air/oil separator 42, the introduction of oil into the air/oil separator inflow 102 is reduced. This is realized by means of the passage openings 108 of the seal 104, because, owing to the perforated-plate-like structure of the seal 104, less oil 22 can pass to the air/oil separator inflow 102. In this way, the introduction of oil into the air/oil separator 42 is reduced.

This has the effect that the air/oil separator 42 can be configured for smaller oil quantities, because, simply by means of the design of the seal 104, considerable oil quantities can be retained and captured at the edges of the passage openings 108 and then flow back on the wall of the seal 104 into the oil sump of the oil 22.

LIST OF REFERENCE DESIGNATIONS

10 Screw compressor
12 Fastening flange
14 Input shaft
16 Screws
18 Screws
20 Housing
20*a* Housing body/Rotor housing

20*b* Housing cover
22 Oil
24 Inlet connector
26 Air filter
28 Air inlet
30 Valve insert
32 Air feed channel
34 Air outlet pipe
36 Riser line
38 Temperature sensor
40 Holder for an air/oil separator
42 Air/oil separator
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
100 Baffle plate
102 Air/oil separator inflow
104 Seal
106 Screw bolt passage opening
108 Passage openings
110 Passage opening
B1 First region
B2 Second region

What is claimed is:

1. A screw compressor for a utility vehicle, comprising:
a housing having at least one housing cover and at least one rotor housing; and
at least one seal formed as a sealing panel with multiple passage openings, the at least one seal being located between vertically-oriented surfaces of the at least one housing cover and the at least one rotor housing,
wherein the multiple passage openings are arranged in a vertically-oriented portion of the seal such that oil is passable between the at least one rotor housing and the at least one housing cover horizontally through the multiple passage openings.

2. The screw compressor as claimed in claim 1, wherein the seal divides an interior of the housing asymmetrically into at least one first region and at least one second region, wherein the first region is smaller than the second region.

3. The screw compressor as claimed in claim 2, further comprising:
an air/oil separator and an air/oil separator inflow, wherein
the air/oil separator inflow opens into the housing interior of the screw compressor, and
the passage openings of the seal are arranged in the vicinity of the air/oil separator inflow.

4. The screw compressor as claimed in claim 3, wherein the air/oil separator inflow is formed in the housing cover.

5. The screw compressor as claimed in claim 3, wherein the air/oil separator inflow opens into the first region of the housing interior.

6. The screw compressor as claimed in claim 1, wherein the passage openings are of substantially round form.

7. The screw compressor as claimed in claim 1, wherein the passage openings are of circular form.

8. The screw compressor as claimed in claim 1, wherein the seal is formed at least in regions as a perforated plate, with the regions situated in the housing interior in the assembled state.

9. The screw compressor as claimed in claim 1, wherein the seal has a baffle plate passage opening.

10. The screw compressor as claimed in claim 1, wherein the seal has screw bolt passage openings which are provided for passage of screw bolts by which the seal, housing cover and rotor housing are screwed together.

* * * * *